US007517270B2

(12) United States Patent
Marzetta

(10) Patent No.: US 7,517,270 B2
(45) Date of Patent: Apr. 14, 2009

(54) CONSTRUCTION SYSTEM

(75) Inventor: Michael Marzetta, Spokane Valley, WA (US)

(73) Assignee: Minds-I, Inc., Liberty Lake, WA (US)

( * ) Notice: Subject to any disclaimer, the term of this patent is extended or adjusted under 35 U.S.C. 154(b) by 240 days.

(21) Appl. No.: 11/443,556

(22) Filed: May 30, 2006

(65) Prior Publication Data

US 2007/0277459 A1 Dec. 6, 2007

(51) Int. Cl.

| | |
|---|---|
| ***A63H 33/12*** | (2006.01) |
| ***A63H 33/06*** | (2006.01) |
| ***A63H 33/04*** | (2006.01) |
| ***A63H 33/00*** | (2006.01) |

(52) U.S. Cl. ..... 446/122; 446/121; 446/113; 446/85

(58) Field of Classification Search ..... 446/85, 446/111–113, 117, 120–126, 128; 411/508–510, 411/913; 403/292, 294, 298; 24/DIG. 35
See application file for complete search history.

(56) References Cited

U.S. PATENT DOCUMENTS

| | | | | |
|---|---|---|---|---|
| 826,621 | A | 7/1906 | Sticht | |
| 1,144,284 | A | 6/1915 | Bassett | |
| 1,248,068 | A | 11/1917 | Brunel | |
| 1,450,471 | A | 4/1923 | Wickersham | |
| 1,985,032 | A * | 12/1934 | Hoult | 446/122 |
| 2,537,621 | A | 1/1951 | Busom | |
| 2,695,095 | A | 11/1954 | Anderson | |
| 2,735,146 | A * | 2/1956 | Purviance | 403/294 |
| 2,855,206 | A * | 10/1958 | Haviland | 279/46.7 |
| 2,885,822 | A | 5/1959 | Onanian | |
| 2,898,798 | A | 8/1959 | Carno | |
| 3,053,579 | A | 9/1962 | Trudeau | |
| 3,112,547 | A | 12/1963 | Poe | |
| 3,159,440 | A | 12/1964 | Courtwright | |
| 3,192,738 | A | 7/1965 | Charles et al. | |
| 3,205,611 | A * | 9/1965 | Onanian | 446/89 |
| 3,229,334 | A | 1/1966 | Thome | |
| 3,231,316 | A | 1/1966 | Ruf | |

(Continued)

FOREIGN PATENT DOCUMENTS

EP 27267 A1 * 4/1981

(Continued)

OTHER PUBLICATIONS

Office Action dated Sep. 3, 2008 for U.S. Appl. No. 11/290,333.

(Continued)

*Primary Examiner*—Gene Kim
*Assistant Examiner*—Alyssa M Hylinski
(74) *Attorney, Agent, or Firm*—Wells St. John, P.S.

(57) ABSTRACT

A construction system is described and which includes a first construction element which has at least one passageway which extends therethrough; a fastener body having a first and a second portion, and wherein the first portion of the fastener body is received in the passageway defined by the first construction element; and a locking member having first and second portions which individually matingly cooperate with the respective first and second portions of the fastener body to secure the fastener body to the first construction element.

23 Claims, 12 Drawing Sheets

U.S. PATENT DOCUMENTS 3,378,219 A 4/1968 Biesecker
3,406,431 A 10/1968 Armstrong et al.
3,469,339 A 9/1969 Thomas
3,538,940 A 11/1970 Graham
3,568,263 A 3/1971 Meehan
3,611,609 A 10/1971 Reijnhard
3,628,834 A 12/1971 Anderson
3,657,838 A 4/1972 Hanning et al.
3,697,104 A 10/1972 Soulie et al.
3,699,709 A * 10/1972 Schmidt ..... 446/113
3,744,101 A 7/1973 Gley
3,755,959 A 9/1973 Boberg
3,811,219 A 5/1974 Fischer
3,837,754 A 9/1974 Malcik
3,857,617 A 12/1974 Grawley
3,916,480 A * 11/1975 Smith ..... 16/383
3,918,130 A 11/1975 Poe
3,975,858 A 8/1976 Much
3,979,855 A * 9/1976 Schmidt et al. ..... 446/112
4,007,516 A 2/1977 Coules
4,057,886 A 11/1977 Brass
4,114,509 A 9/1978 Poe
4,137,115 A 1/1979 Lambert
4,141,599 A 2/1979 Stolz
4,214,403 A * 7/1980 Knudsen ..... 446/104
4,300,850 A 11/1981 de la Haye et al.
4,390,214 A 6/1983 Gunter et al.
4,405,272 A 9/1983 Wollar
4,425,049 A 1/1984 Travis
4,448,273 A 5/1984 Barbieri
4,531,870 A 7/1985 Moryl et al.
4,551,110 A 11/1985 Selvage et al.
4,589,853 A 5/1986 Hidvegi
4,599,011 A 7/1986 Tashiro et al.
4,674,930 A 6/1987 Poe et al.
4,694,556 A 9/1987 Hewitt
4,729,606 A 3/1988 Narita et al.
4,805,365 A 2/1989 Bastian
4,823,532 A 4/1989 Westerburgen
4,968,040 A * 11/1990 McElhaney ..... 273/294
5,009,599 A 4/1991 Mueller
5,049,104 A 9/1991 Olsen
5,143,500 A * 9/1992 Schuring et al. ..... 411/339
5,322,466 A * 6/1994 Bolli et al. ..... 446/121
5,421,556 A 6/1995 Dodge et al.
5,726,023 A 3/1998 Cheever et al.
5,823,700 A 10/1998 Poworoznek
5,839,938 A 11/1998 Manthei et al.
5,881,515 A 3/1999 George
5,928,051 A 7/1999 Krog
5,938,497 A * 8/1999 Mott ..... 446/122
5,964,635 A 10/1999 Krog
6,045,309 A 4/2000 LeVey
6,139,214 A 10/2000 Zirps et al.
6,301,747 B1 10/2001 Parein
6,345,946 B1 * 2/2002 Mainini et al. ..... 411/508
6,461,215 B1 10/2002 Kunz et al.
6,481,942 B2 * 11/2002 Tanaka ..... 411/45
6,540,461 B1 * 4/2003 Hawang ..... 411/48
6,595,825 B1 7/2003 De Wilde
6,682,385 B2 1/2004 Atzen et al.
6,736,691 B1 5/2004 Bach
7,314,132 B2 1/2008 Layne et al.

FOREIGN PATENT DOCUMENTS

WO WO 2006/045068 4/2006

OTHER PUBLICATIONS

Office Action dated Jul. 10, 2008 for U.S. Appl. No. 11/443,446.
Office Action dated Jul. 17, 2008 for U.S. Appl. No. 11/526,264.

* cited by examiner

CONSTRUCTION SYSTEM

TECHNICAL FIELD

The present invention relates to a construction system, and more specifically to a construction system which includes a plurality of construction elements, and a fastener which, in combination, are particularly useful in constructing toys and hobby crafts of various designs and arrangements.

BACKGROUND OF THE INVENTION

Children and hobbyists have long enjoyed creative toys which have allowed the individual to construct various items of interest such as boxes, small houses, bridges, airplanes, boats and the like. Examples of such products have included the Erector™ Set and various Lego™ Kits which are provided at various levels of complexity. In the so called Erector™ products, these toys have included a series of plates and bars with holes in them which are subsequently joined together with nuts and a corresponding bolt. Other creative toys have included somewhat similar building units but have further used wooden pegs to join the building units together.

In my U.S. patent application Ser. No. 11/290,333, and which was filed on Nov. 29, 2005, I disclosed a construction system which included a construction element which had at least one passageway which extended therethrough; a fastener body telescopingly received, at least in part, in the passageway and which extends, at least in part, outwardly relative to the construction element; and a locking member cooperating with the fastener body, and which in a first position allows the fastener body to be telescopingly received, at least in part, within the passageway defined by the construction element, and in a second position substantially impedes the removal of the fastener body from the passageway defined by the construction element. While this construction system, as described in this patent application, operates with a great deal of success, it is not useful for joining or otherwise fastening construction elements together such that the elements can be oriented, for example, in the same plane, or other advantageously angulated orientations.

A construction system which avoids the shortcomings attendant with the prior art devices and practices utilized heretofore is the subject matter of the present application.

SUMMARY OF THE INVENTION

A first aspect of the present invention relates to a construction system which includes a first construction element which has at least one passageway which extends therethrough; a fastener body having a first and a second portion, and wherein the first portion of the fastener body is received in the passageway defined by the first construction element; and a locking member having first and second portions which individually matingly cooperate with the respective first and second portions of the fastener body to secure the fastener body to the first construction element.

Another aspect of the present invention relates to construction system which includes a first and a second construction element each having at least one passageway which extends therethrough; a fastener body having a support member which has opposite first and second ends, and an intermediate region therebetween the first and second ends, and a top and bottom surface, and wherein the fastener body further has a first and a second portion which are disposed in predetermined spaced relation, one relative to the other, and which extend normally outwardly relative to the opposite first and second ends of the support member, and wherein the first and second portions of the fastener body are dimensioned so as to be individually telescopingly received within the respective passageways defined by the first and second construction elements; and a locking member having a support member which has opposite first and second ends, and an intermediate region therebetween the first and second ends, and a top and bottom surface, and wherein the locking member further has a first and a second portion which are disposed in predetermined spaced relation one relative to the other, and which extend normally outwardly relative to the opposite first and second ends of the support member, and wherein the first and second portions of the locking member are dimensioned to be individually telescoping received within the respective passageways defined by the first and second construction elements and to further individually telescopingly and releasably cooperate with the first and second portions of the fastener body to secure the fastener body to the first and second construction elements.

Still another aspect of the present invention relates to a construction system which includes first and second construction elements each having a passageway formed therein, and which extends therethrough, and wherein each passageway has at least one orientation groove which communicates with, and extends along, the respective passageways; a fastener body having resiliently deformable first and second portions which are dimensioned for telescoping, mating receipt within the respective passageways defined by each of the first and second construction elements, and wherein each of the first and second portions have an exterior facing surface which defines at least one tongue which is dimensioned to matingly cooperate with at least one orientation groove defined by each of the passageways of the respective first and second construction members, and wherein each portion of the fastener body has an interior facing surface which defines a longitudinally extending passageway which extends therethrough, and wherein the first and second portion of the fastener body are located in predetermined spaced relation, one relative to the other; a locking member having resiliently deformable first and second portions which are dimensioned for telescoping mating receipt within the respective longitudinally extending passageways that are defined by each of the first and second portions of the fastener body, and wherein each of the first and second portions of the locking member has an exterior facing surface having an outside diametral dimension, and a distal end having a second outside diametral dimension, and wherein the second outside diametral dimension is greater than the first outside diametral dimension, and wherein the first and second portions of the fastener body are located in predetermined, spaced relation, one relative to the other, and wherein the fastener body and locking member matingly cooperate with the first and second construction elements to releasably attach the first and second construction elements together in a fixed orientation, one relative to the other.

Another aspect of the present invention relates to a construction system which includes a first construction element which has at least one passageway which extends therethrough; a fastener body having a first and a second portion which are resiliently deformable, and wherein the respective first and second portions each have an exterior facing surface which is individually dimensioned for mating receipt within the at least one passageway defined by the first construction element, and wherein at least one of the first or second portions is received in the passageway defined by the construction element, and wherein the construction element is freely rotatable relative thereto; and a locking member having first and second portions which individually matingly cooperate with the respective first and second portions of the fastener body to secure the fastener body to the first construction element.

Yet another aspect of the present invention relates to a construction system which includes a first construction element having a main body which has a passageway extending therethrough; a fastener body having a main body which is matingly received within the passageway defined by the construction member, and which further defines a passageway which extends therethrough; a locking member having a main body which is matingly received within the passageway defined by the construction element, and which further defines a passageway which extends therethrough, and which is substantially coaxially aligned relative to the passageway formed in the fastener body; and a second construction element having a shaft which is dimensioned to be received within the coaxially aligned passageways as defined by the fastener body and locking member respectively.

These and other aspects of the present invention will be described in greater detail hereinafter.

BRIEF DESCRIPTION OF THE DRAWINGS

Preferred embodiments of the invention are described below with reference to the following accompanying drawings.

FIG. 14 is a fragmentary, side elevation view of still another form of construction system of the present invention.

FIG. 16 is a perspective, exploded side elevation view of yet another form of the present invention.

FIG. 17 is a perspective, assembled view of the form of the invention as seen in FIG. 16.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
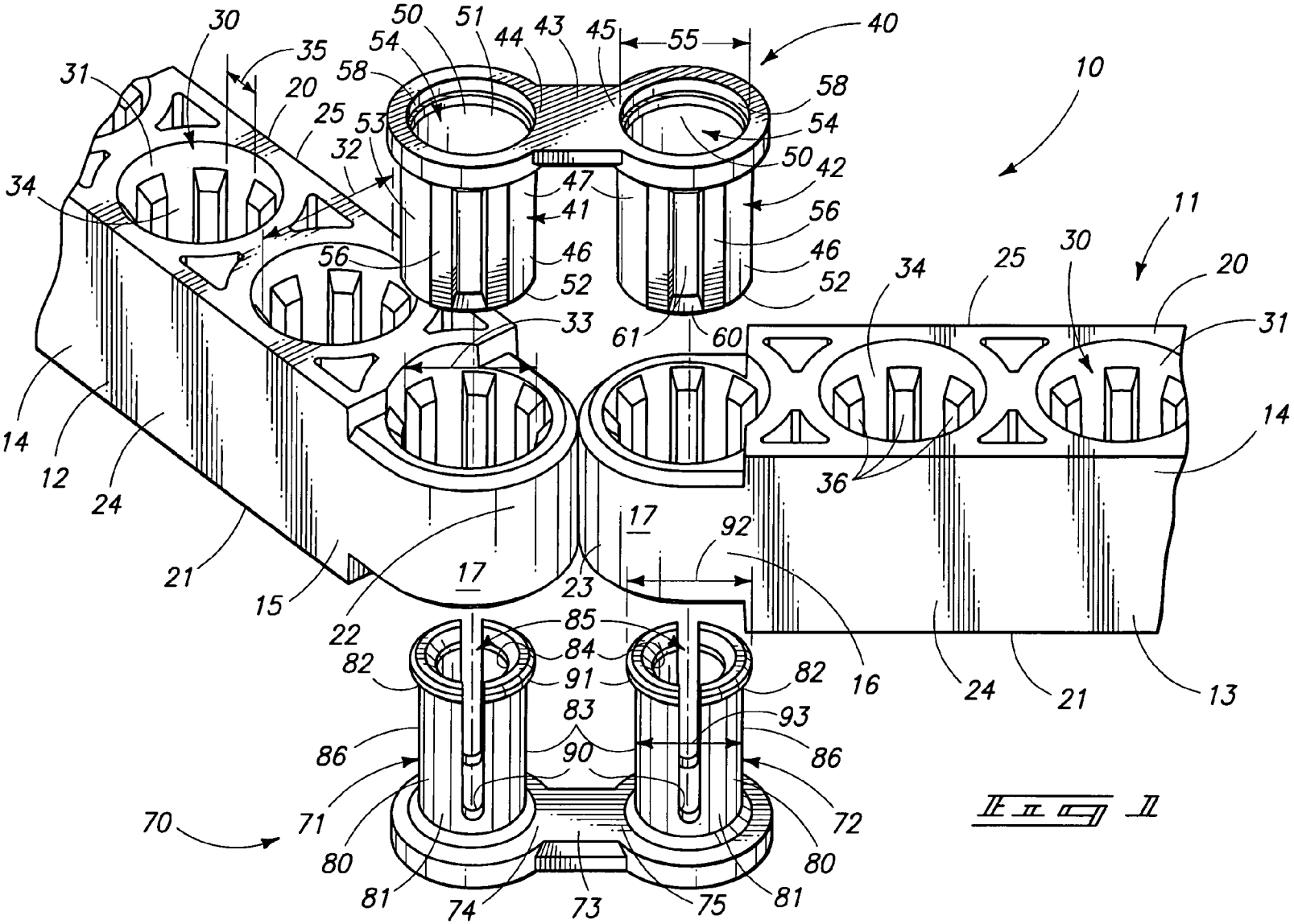
FIG. 1 is a fragmentary, perspective, exploded, side elevation view of the construction system of the present invention.
Figure 2:
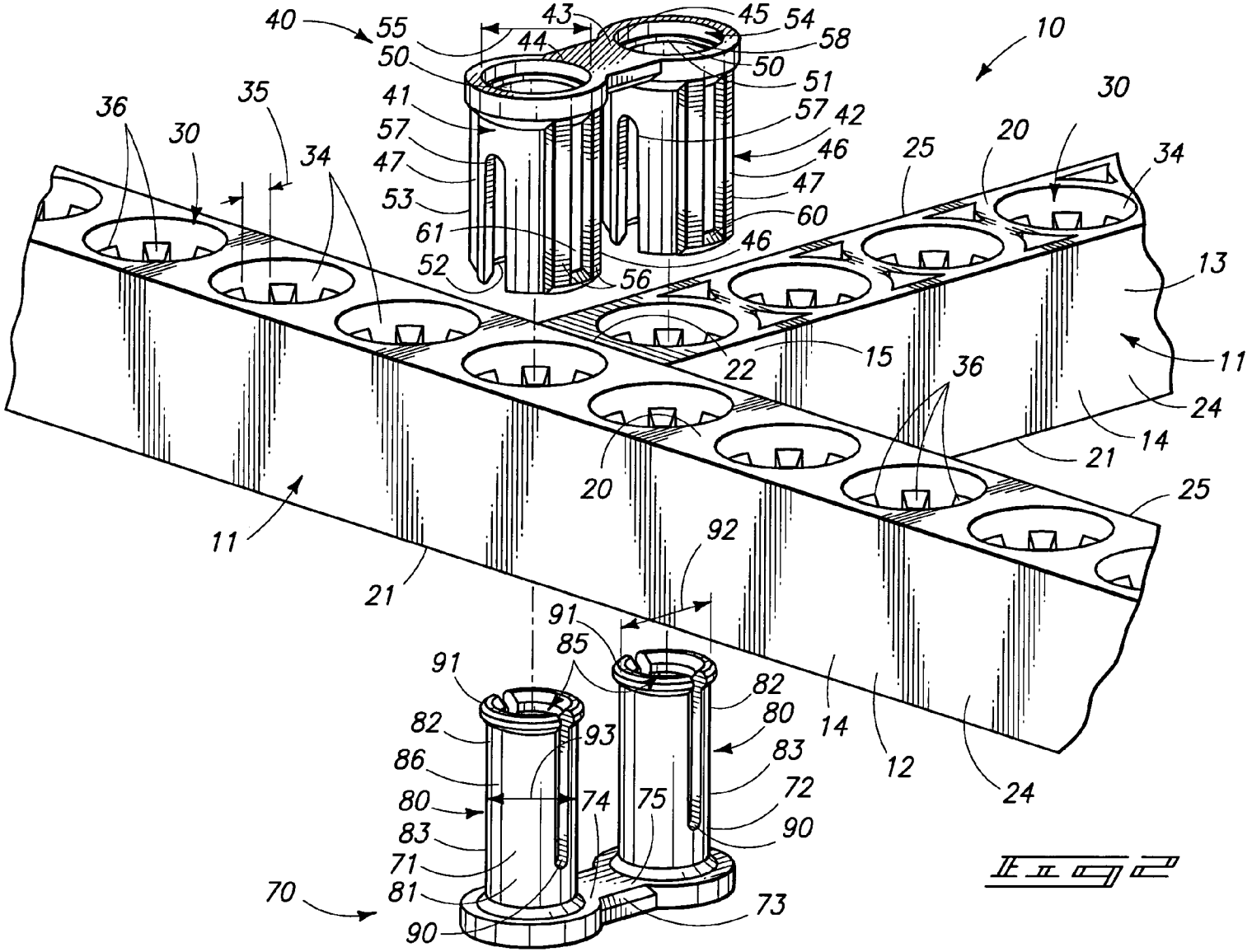
FIG. 2 is a fragmentary, perspective, exploded, side elevation view of the construction system of the present invention shown in a second orientation.
Figure 3:
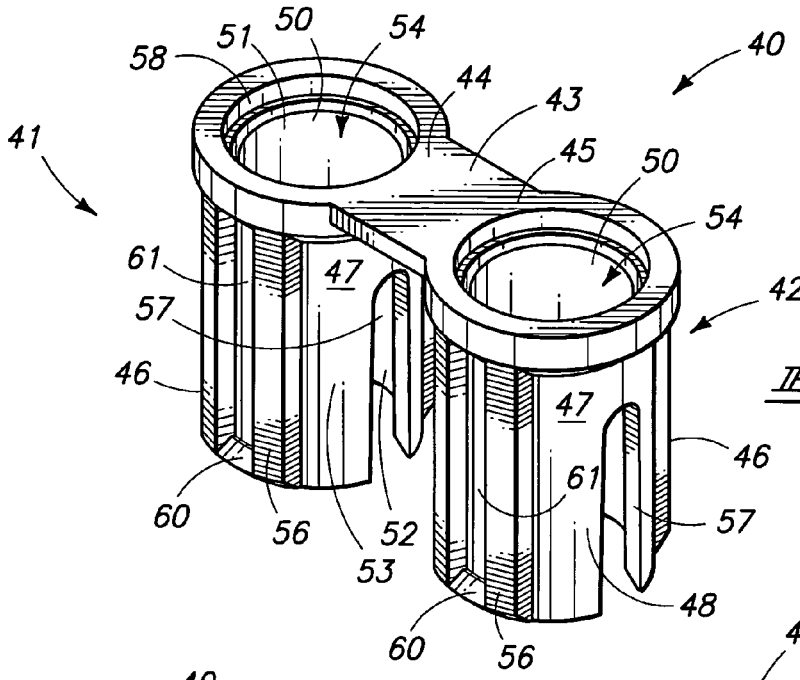
FIG. 3 is a fragmentary, perspective, side elevation view of a fastener body which is a feature of the construction system of the present invention.
Figure 5:
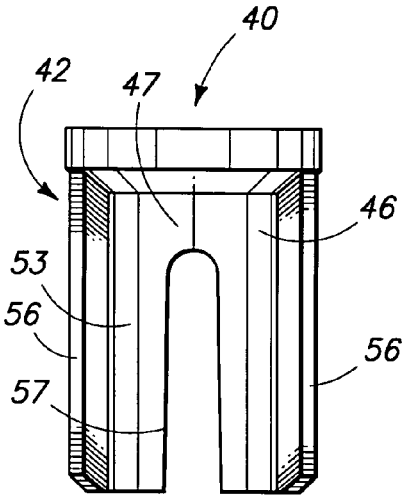
FIG. 5 is a side elevation view of a fastener body of the present invention.
Figure 4:
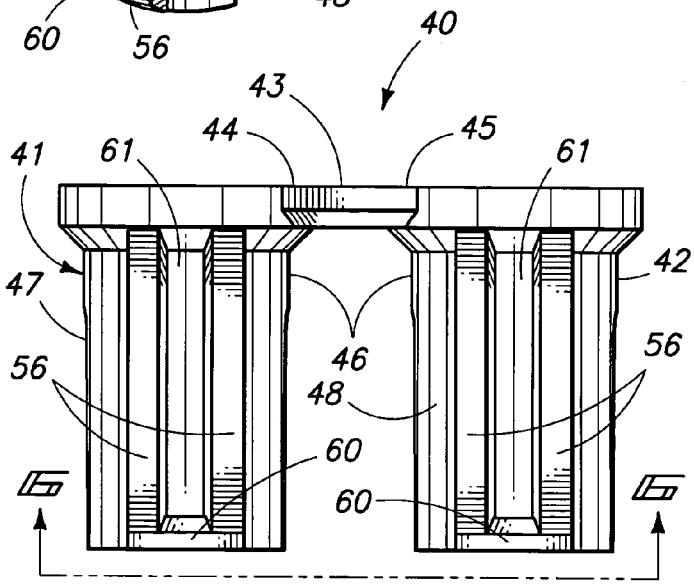
FIG. 4 is a end view of a fastener body of the present invention.
Figure 6:
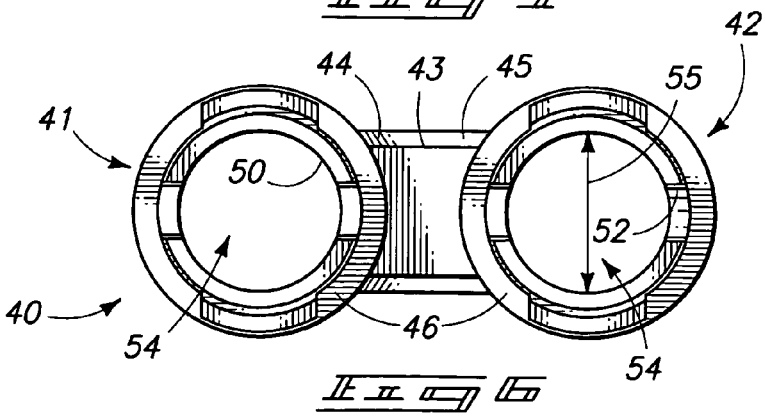
FIG. 6 is a bottom plan view of the fastener body of the present invention and which is taken from a position along line 6-6 of FIG. 4.
Figure 7:
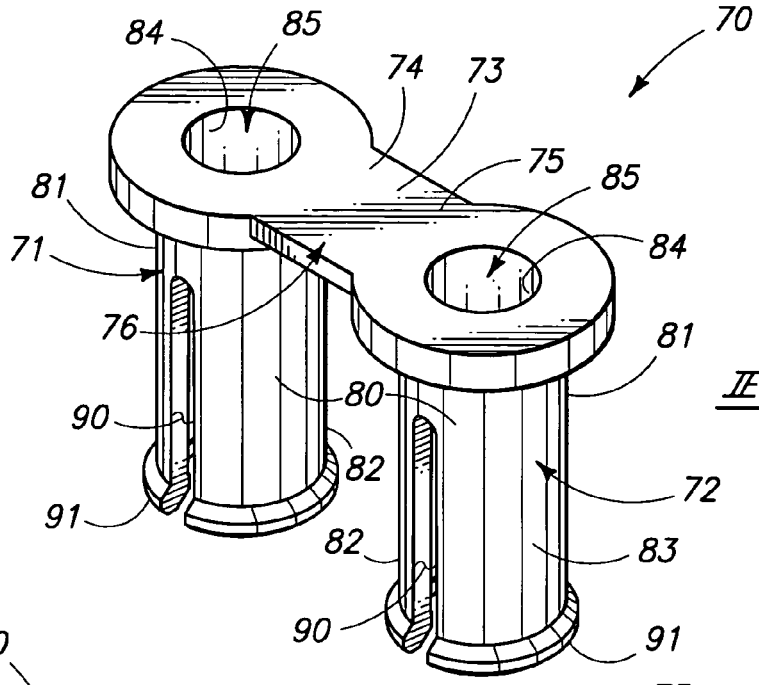
FIG. 7 is a fragmentary, perspective, side elevation view of a second form of the fastener body of the present invention.
Figure 9:
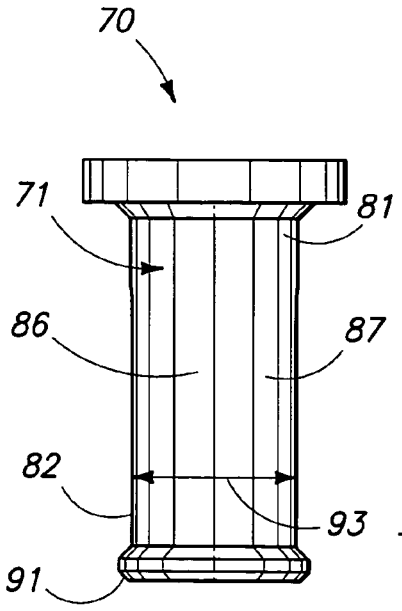
FIG. 9 is an end view of the second form of the fastener body of the present invention.
Figure 8:
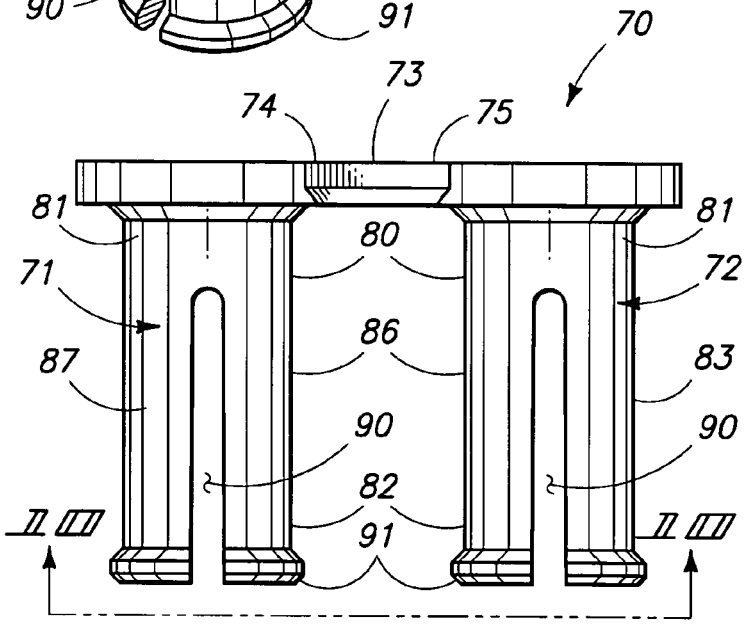
FIG. 8 is a second side elevation view of the second form of the fastener body of the present invention.
Figure 10:
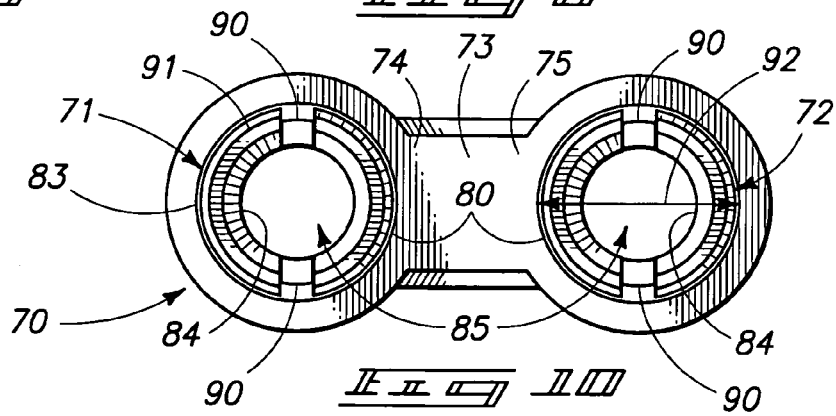
FIG. 10 is a bottom plan view of the second form of the fastener body of the present invention and which is taken from a position along line 10-10 of FIG. 8.
Figures 11A, 11B:
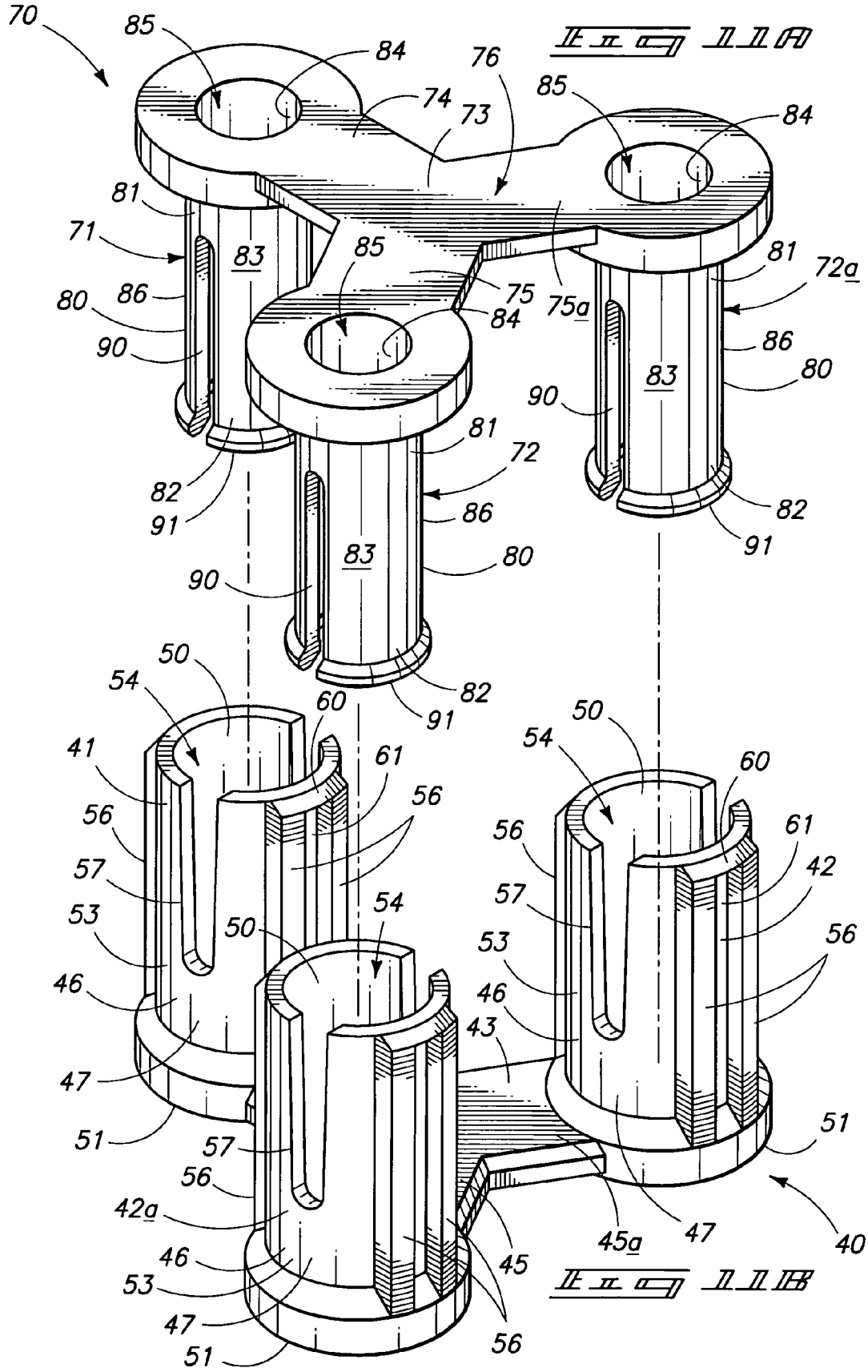
FIG. 11 is a fragmentary, perspective, side elevation view of a third form of the fastener body of the present invention.
Figure 18:
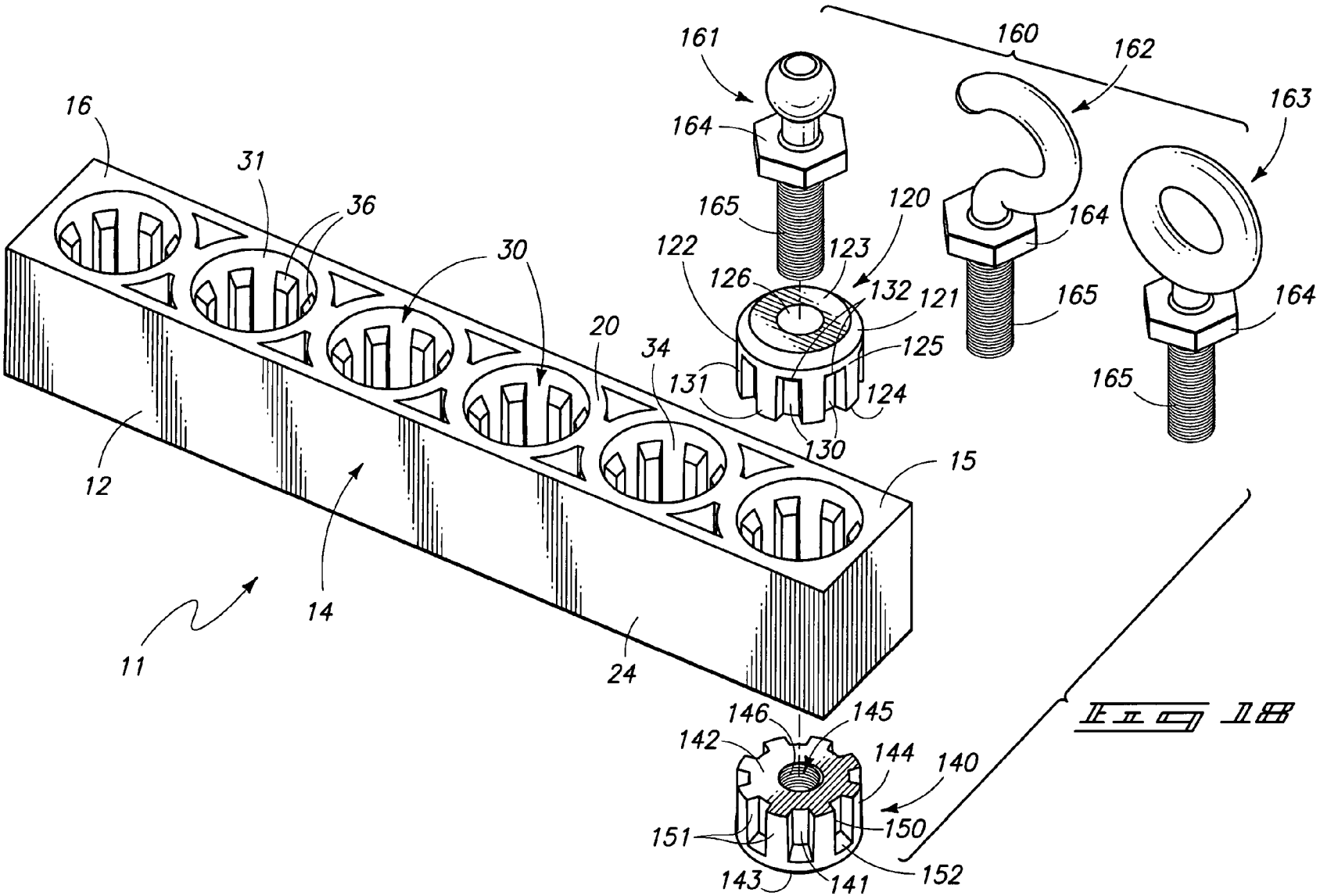
FIG. 18 is a perspective, exploded, side elevation view of yet another form of the present invention.

The first form of the construction system of the present invention is generally indicated by the numeral 10 in FIGS. 1-10, respectively. As seen in the, drawings provided with this application, and in all the forms of the invention, as will be discussed hereinafter, the construction system 10 of the present invention includes at least one construction element which is generally indicated by the numeral 11 therein. In the various drawings, the construction element 11 includes a first construction element 12, and a second construction element which is generally indicated by the numeral 13. The respective construction elements may be of similar or different lengths and shapes as seen from the various drawings. Therefore, in the drawings, similar numbers will denote similar structure in the first and second construction elements 12 and 13. In this regard, the respective construction elements each have a main body 14 having opposite first and second ends 15 and 16, respectively. As seen in the drawings, the opposite first and second ends each have a rounded sidewall 17. In an alternative form of the construction element, the first and/or second ends can be substantially planar or squared-off as seen in FIG. 2 or FIG. 18. It should also be recognized that the construction element as seen in my earlier filed U.S. patent application Ser. No. 11/290,333, filed on Nov. 29, 2005 can be employed with the present invention. The respective construction elements 11 include a top surface 20; a bottom surface 21; and first, second, third and fourth sidewalls generally indicated by the numeral 22, 23, 24 and 25, respectively. The top and bottom surfaces, as well as the sidewalls, as described herein generally assume the form of a narrowly rectangular block like member. However, it should be appreciated that the construction element 11 may take on assorted different forms and shapes including cylindrical and other non-rectangular shaped forms as will become apparent from the discussion which follows. For example, one possible arrangement for the shape of the main body 14 may include a block like member, and wherein the main body has an arched or curved form. Additionally, it should be recognized that while the block is illustrated as having a narrowly rectangular shape, it will be appreciated that the main body 12 may assume different configurations such as being formed into a square, curve, round, S-shaped, or I-shaped forms depending upon the intended use of the construction element 11. Therefore, the construction elements as illustrated herein are merely illustrative of only two possible forms of the construction element of the present invention.

As seen from FIG. 1 and following, the construction element 11 having the top and bottom surfaces and the first, second, third and fourth sidewalls 20-25, respectively are positioned in generally perpendicular or normal relation relative to each other to form a generally narrowly rectangular shape. The top and bottom surfaces are typically planar, however, in certain forms of the invention the construction element 11 may have a curved or other geometric shapes. Consequently, the top and bottom surfaces or the third and fourth sidewalls may have different configurations, one relative to the other. In the construction system 10 of the present invention, the construction element has at least one passageway 30 formed therein and which extends therethrough. As illustrated in the drawings, the construction elements may be formed to include a plurality of passageways which extend through the top surface 20 to the bottom surface 21. Further, in my earlier patent application Ser. No. 11/290,333 and which was filed on Nov. 29, 2005, I further disclosed a construction element which may also include passageways which extend through the third sidewall 24, main body 14, and through the fourth sidewall 25. In this form of the invention, vertically disposed passageways are positioned therebetween substantially horizontally disposed passageways. As should be appreciated from this discussion, the passageways 30 may be in alternating, consecutive or other arrangements based upon the construction element 11 being designed. The teachings of my earlier patent are incorporated by reference herein.

The passageway 30 which is formed through the main body 14 is defined by a sidewall 31 which defines a first maximum inside diametral dimension 32 for the passageway 30. Further, the sidewall 31 defines a second minimum inside diametral dimension 33 as seen in FIG. 1. The second inside diametral dimension 33 is less than the first diametral dimension 32. Additionally, the passageway 30 defines at least one orientation groove 34 which extends, at least in part, through the construction element 11 and between the opposite sides of the construction element 11. As seen in FIG. 1, and following, a plurality of orientation grooves are formed in substantially equally spaced relation about the circumference of the passageway 30. Each of the orientation grooves have a length dimension which is less than the length dimension of the respective passageways 30, and a width dimension generally indicated by the numeral 35. As seen in the drawings, the passageway 30 is defined, at least in part, by a plurality of spaced ribs 36 which extend radially inwardly and which further define the respective orientation grooves therebetween.

Figure 12:
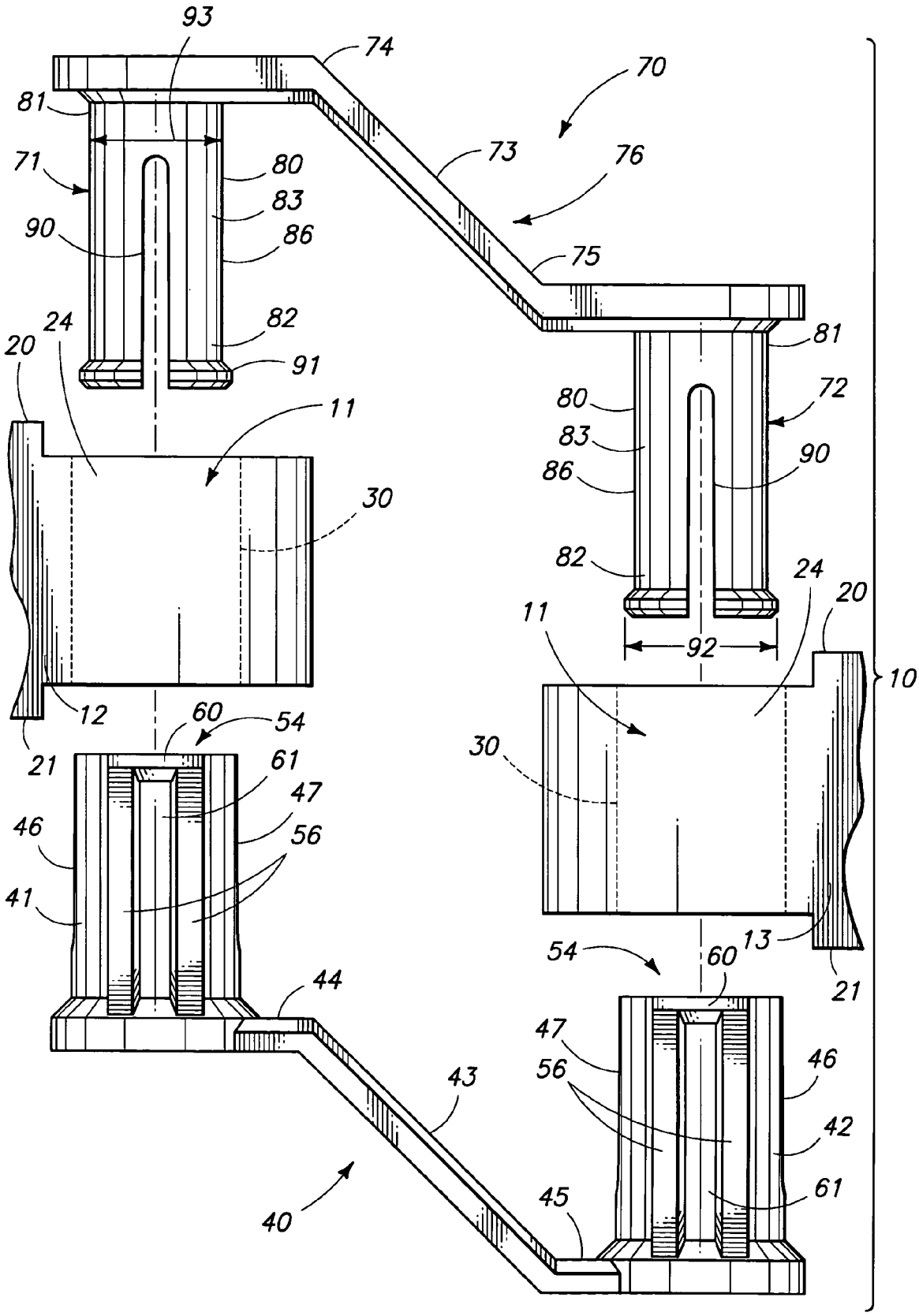
FIG. 12 is a fragmentary, perspective, exploded, side elevation view of a third form of the construction system of the present invention.
Figure 13:
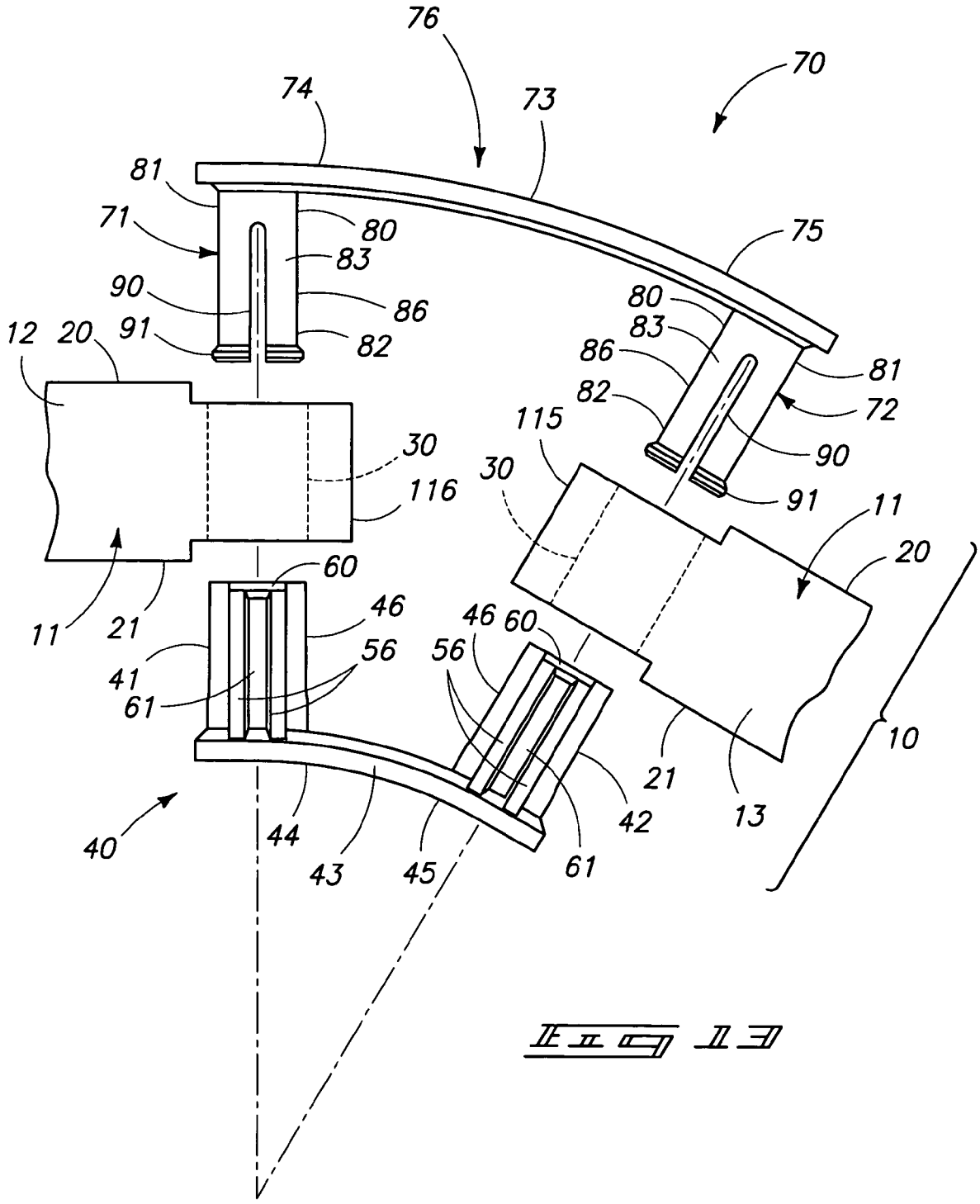
FIG. 13 is a fragmentary, side elevation view of yet another form of the construction system of the present invention.
Figure 11A:
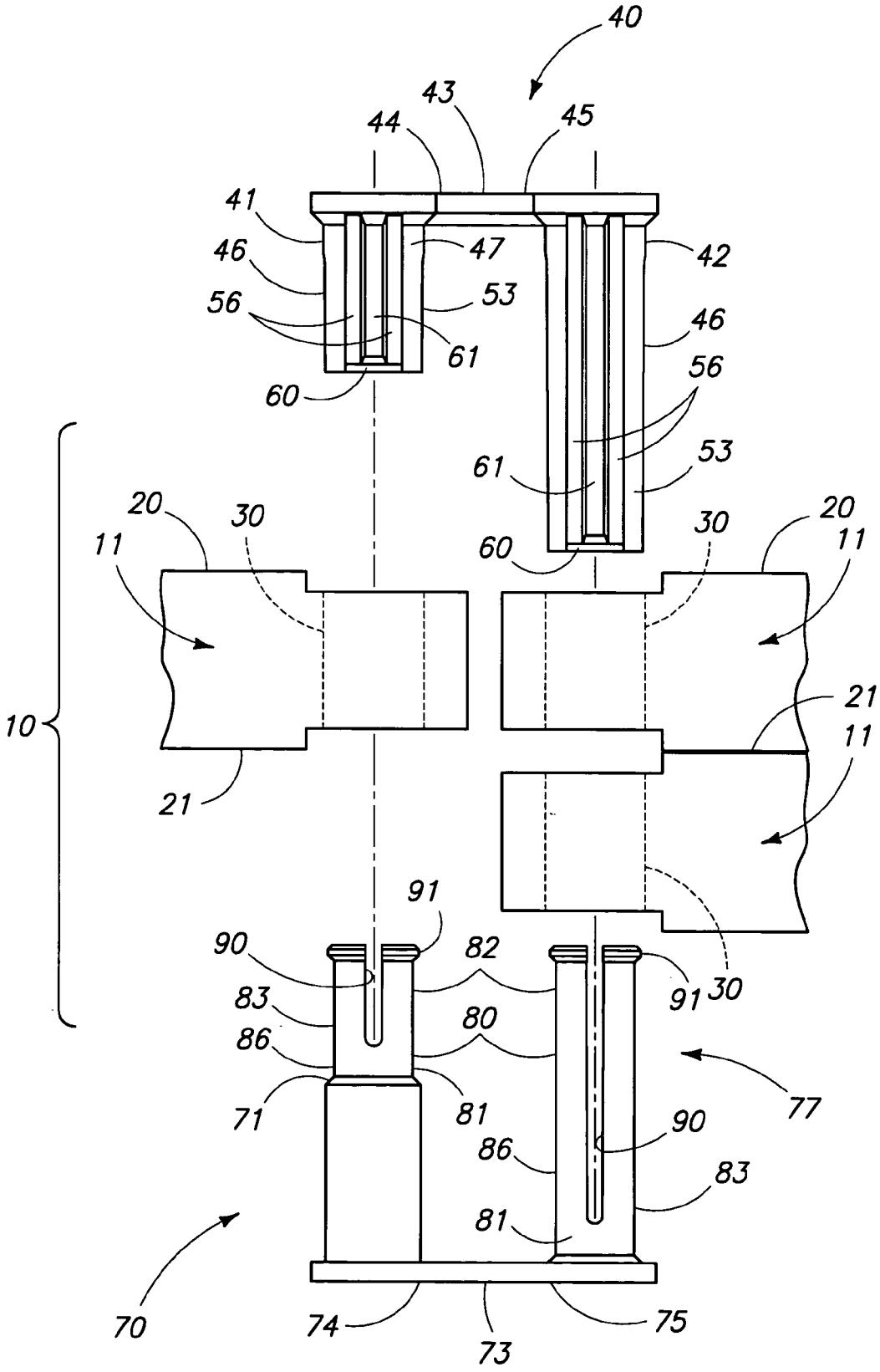

The construction system of the present invention includes a fastener body which is generally indicated by the numeral 40 in FIG. 1, and following. An alternative form of the fastener body, and which is designated as 40A is further seen in FIG. 18. The fastener body has several forms as seen in FIGS. 3, 11A, 12, 13, 14 and 15, respectively. Another form of the fastener body and which is best seen in FIGS. 16, 17 and 18 will be discussed later in the application. These are illustrative of only a small number of the possible combinations of the fastener body construction that can be used in the present invention. Each of the forms of the fastener body 40 as seen in these drawings have first and second portions 41 and 42, respectively which are dimensioned for individual telescoping, mating receipt within the respective passageways 30 which are defined by each of the first and second construction elements 12 and 13, respectively. As seen in the drawings, the first and second portions are joined together by a support member which is generally indicated by the numeral 43. In several forms of the invention as seen in FIGS. 1-6, 11A, 12, and 14, respectively, the support member positions the respective first and second portions in spaced, substantially parallel relation, one relative to the other. In an alternative form of the invention as seen in FIG. 13, the support member 43 may be angulated or otherwise curved in order to position the respective first and second construction members in various angular orientations, one relative to the other. Therefore, the support member 43 may be substantially planar, angulated, or curved or combinations thereof in order to achieve the benefits of the present invention.

The support member 43 has a first end 44 and an opposite second end 45. The first and second portions of the fastener body 41 and 42 extend downwardly, and in some cases, normally downwardly relative to the first and second ends 44 and 45, respectively. As seen in the drawings, each of the first and second portions of the fastener body 41 and 42 have a main body 46 which has an exterior facing surface 47 which is generally substantially cylindrically shaped and which, generally speaking, has an outside diametral dimension which is less than the minimum inside diametral dimension 33 of the respective passageways 30. Each main body 46 further has a length dimension which is typically equal to or less than about the length dimension of the respective passageways 30. In addition to the foregoing, the fastener body has an inside or interior facing surface 50 having a first end 51 and an opposite second end 52. In addition to the foregoing, the exterior surface 47 has an intermediate portion 48. The inside or interior facing surface 50 defines a longitudinally extending passageway 54 which has a predetermined inside diametral dimension 55. As seen in the drawings, and extending substantially radially outwardly relative to the exterior facing surface 47 is at least one tongue 56 which has a length dimension and a width dimension which allows it to be slideably and matingly received within one of the orientation grooves 34 as defined within at least one of the passageways 30 of the respective first and second construction elements 12 and 13, respectively. As should be understood from the drawings, and in certain forms of the invention, the radially extending tongue may be completely absent; or in other forms of the invention, may be present on only one of the first or second portions 41 and 42 of the fastener body 40. Therefore, depending upon the form of the invention that is employed, the first construction element 12 may be free to rotate about the first portion 41 of the fastener body 40. This form of the invention will be discussed hereinafter by reference to FIGS. 16 and 17. As illustrated in FIG. 1, it should be understood that the first and second construction elements 12 and 13, when engaged by the fastener body 40, as presently illustrated, cannot rotate about the first and second portions 41 and 42 of the fastener body 40. In view of the previous discussion, and depending upon the arrangement of the fastener body 40, one construction member 11 may be disposed in a fixed angulated relationship relative to the fastener body 40 and the other may be either fixed in a given angulated relationship, or otherwise free to rotate relative thereto. This allows the fastener body 40 to facilitate the construction of various end products having assorted different functions.

Figure 15:
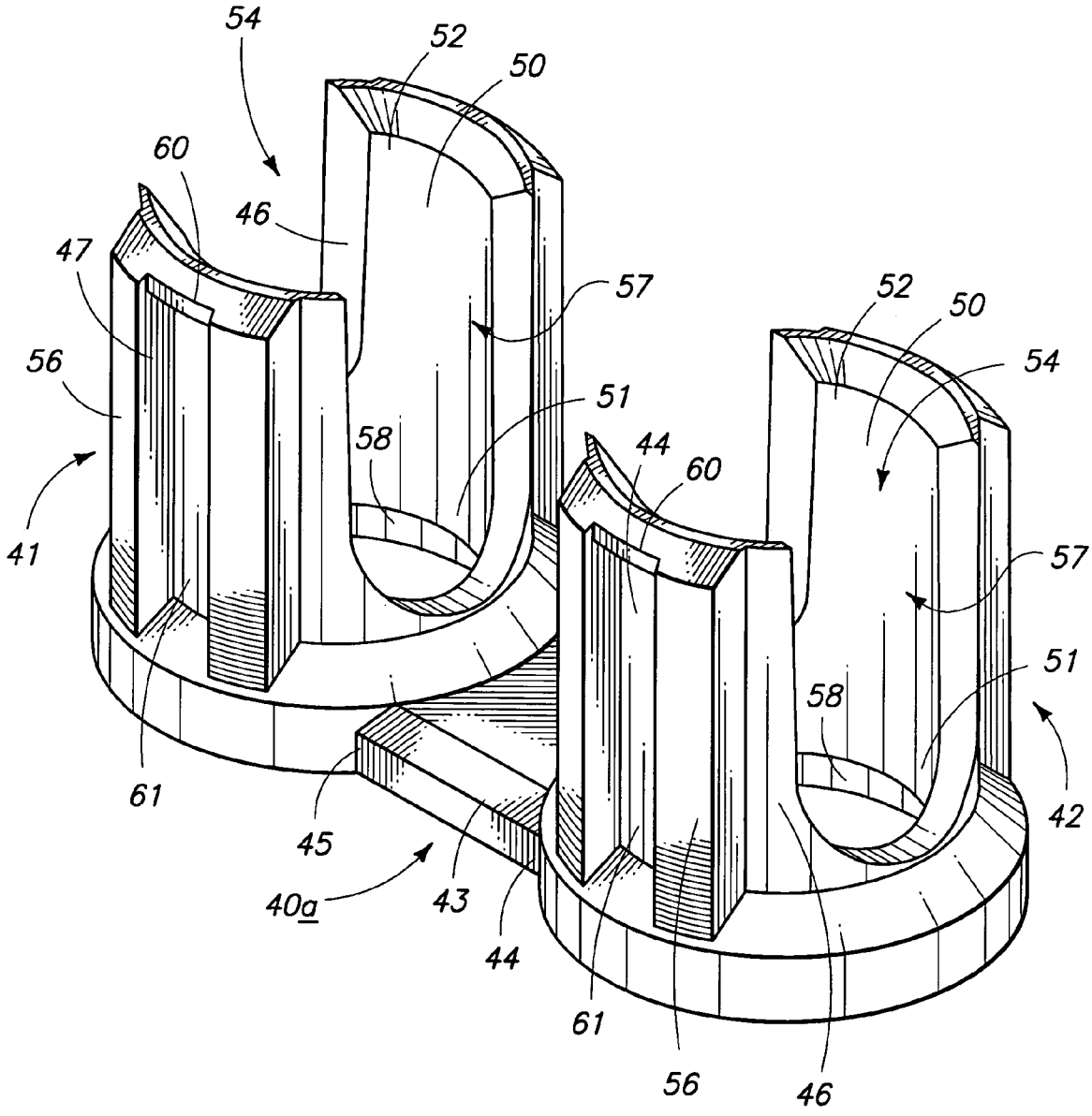
FIG. 15 is a perspective, side elevation view of an alternative form of a fastener body as utilized in the present invention.

As will be appreciated, in one form of the invention, the first and second portions 41 and 42 of the fastener body 40 each have a similar length dimension which allows them to individually engage at least one construction element. In another form of the invention as seen in FIG. 14, the main bodies 46 of the respective first and second portions may have different length dimensions. In particular, and as seen in FIG. 14, the length dimension of the second portion 42 allows the main body 46 to extend therethrough two construction elements 11 which are disposed in substantially parallel relation one relative to the other. As seen in FIG. 1, and following, a pair of longitudinally extending grooves, gaps or passageways 57 are formed in the main body 46 of each of the first and second portions 41 and 42 to render, at least in part, a portion of the main bodies 46 of each of the first and second portions 41 and 42 resiliently deformable. As seen in FIG. 15, the alternative form of the fastener body 40A may have greatly enlarged longitudinally extending grooves 57 when compared to FIG. 3. This permits the main body of these structures to be easily received within the passageways 30 of the respective first and second construction elements 12 and 13 respectively. In addition, it will be seen that circumscribing seat, groove or channel 58 is formed in the interior facing surface 50 near the first end 51. The function of this circumscribing seat will be described in greater detail, hereinafter.

As best seen in FIGS. 1-4, and 11-13, a partial circumscribing flange 60 is positioned on the exterior surface 47, near the second end 52, and extending therebetween the spaced tongues 56. The pair of spaced longitudinally extending tongues, and the partially circumscribing flange 60 define a cavity 61 therebetween. This cavity matingly receives the individual ribs 36 which extend radially inwardly relative to the passageway 30, and which form, at least in part, the orientation groove 34. As earlier disclosed, the orientation groove matingly receives the respective tongues 56. Further, the respective ribs 36 are received in the cavity 61, and the respective first and second portions of the fastener body become releasably affixed to the respective construction elements 12 and 13, respectively in the manner of a snap-fit. Additionally, the flange 60 captures the respective ribs in the cavity 61.

Referring now to FIG. 1, and following, the present construction system 10 includes a locking member which is generally indicated by the numeral 70 and which further has a first portion 71, and a second portion 72. These respective portions individually matingly cooperate with the first and second portions 41 and 42 of the fastener body 40 to secure the fastener body 40 to the respective construction elements 11. As seen in the drawings, the first and second portions 71 and 72 of the locking member are joined together by a support member 73 which has a first end 74, and an opposite second end 75 which are connected to the respective first and second portions 71 and 72, respectively. An intermediate region 76 is defined between the first and second ends 74 and 75. As should be understood, the support member 73 may be substantially planar as seen in FIG. 1, or further can be angulated as seen in FIG. 12; or still further curved as seen in FIG. 13. Other geometries are possible. For several forms of the invention as disclosed, the support member 73 is operable to position the first and second portions 71 and 72 of the locking member 70 in substantially parallel, spaced relationship. However, and by reference to FIG. 13, it should be recognized that in some forms of the invention, the support member 73 may be angulated or otherwise curved in order to position the respective construction members 11 and 12 in different orientations one relative to the other.

The locking member 70 as seen in the various forms of the invention includes first and second portions 71 and 72 each having a main body 80 having a first end 81 and an opposite second end 82. The main body of the respective first and second portions has a given length dimension so as to facilitate its insertion through at least one of the construction members 11, and further through the longitudinally extending passageway 54 which is defined by the main body 46 of one of the first and second portions 41 and 42 of the fastener body 40. In several of the forms of the invention 10, the main body 80 of the respective portions 71 and 72 each have the same length dimension. However, and as seen in FIG. 14, in yet another form of the invention, the respective length dimensions of the first and second portions 71 and 72 are different so as to allow at least one of the portions 71 and/or 72 to engage at least two construction members 11.

The main body 80 of each of the first and second portions 71 and 72 has an exterior surface 83 and an interior surface 84 which defines a longitudinally oriented passageway 85. This passageway extends between the first and second ends 81 and 82 of the main body. The main body 80 further has an intermediate portion 86 which is located therebetween the first and second ends 81 and 82. As illustrated in the various drawings, a pair of elongated substantially longitudinally disposed channels 90 are formed through the main body 80 and which render the second end 82 of the main body 80 resiliently deformable. Still further, a discontinuous flange member 91 is formed about the exterior surface 83 at the second end 82. The discontinuous flange 91 extends radially outwardly relative to the main body 80 and has an outside diametral dimension which is generally indicated by the numeral 92 (FIG. 12). Still further, the intermediate portion 86 of the main body 80 has an outside diametral dimension 93 which is less than the outside diametral dimension of the discontinuous flange 91. As should be understood, the respective main bodies 80 of the first and second portions 71 and 72 are dimensioned so as to be telescopingly received within the longitudinally extending passageways 54 of the respective first and second portions 41 and 42 of the fastener bodies 40 after the first and second portions 41 and 42 of the fastener body have been received or otherwise inserted in the respective passageways 30. It should be understood that the second end 82 of the main body of each of the first and second portions 71 and 72 are resiliently deformable so as to permit the main body to be telescopingly received within the longitudinally extending passageway 54. Still further, and when appropriately inserted, the discontinuous flange 91 is operable to be releasably matingly received in the circumscribing seat 58 which is formed in the interior facing surface 50 at the first end 51 of the longitudinally extending passageway 54 in the nature of a snap-fit. In this way, the locking member 70 is releasably secured to the fastener body 40 and thereby secures the respective construction members 11 to each other, and in various orientations so as to be useful in forming various end products. Force of a given magnitude applied to the first end 81 of the locking member 70 is effective in removing the locking member from the passageway 54, and facilitating disassembly of same. More specifically, the insertion of the locking member portions 71 and 72 into the passageways 54 impedes the fastener body portions 41 and 42 from being resiliently deformed. This causes the partially circumscribing flange 60 to hold firmly thereagainst the top or end of the ribs 36. This arrangement creates a lock which does not permit the construction elements to be removed from one another, or the fastener body 40 from being removed from the construction element.

An alternative form of the fastener body which was earlier discussed, and which is further labeled by the numeral 40 is best seen by reference to FIGS. 16 and 17, respectively. With respect to the earlier form of the fastener body 40 as seen in views such as FIGS. 3 and 15, respectively, discussion was earlier provided that the fastener body could be arranged in a fashion so as to permit relative rotation of one of the construction members 12 or 13 thereabout same. As seen in FIGS. 16 and 17, an alternative form of the fastener body 100 is illustrated and wherein the form of the invention as seen in those views permits relative rotation of one of the construction elements, here illustrated as numeral 13 thereabout a portion of the fastener body 100. More specifically, the fastener body 100 as seen in FIGS. 16 and 17 includes a first portion 101 and second portion 102. Each of the first and second portions 101 and 102 has a main body 103 which has a length dimension which allows the main body 103 to be inserted within the passageways 30 as defined by the respective construction elements 12 and 13 as illustrated. Still further, each of the first and second portions has an exterior facing surface 104. As seen in FIG. 16, the first portion 101 includes a pair of spaced tongues 105 which extend substantially radially outwardly relative to the exterior surface 104, and which are dimensioned for mating receipt in the orientation grooves 34 as defined by the respective passageways 30 as formed in the respective construction elements. This is similar to that which was earlier described with respect to the fastener body 40. Each of the first and second portions 101 and 102 further defines a longitudinally extending passageway 106 which extends from the first end 110 of the respective first and second portions to the opposite second end 111 thereof.

As seen in FIG. 16, the second portion 102 of the fastener body 100 is devoid of any radially extending protuberances such as the spaced tongues 105 as shown on the first portion 101. As seen in FIG. 16, the first and second portions 101 and 102 each include a flange 112 which is disposed at least in partially circumscribing relation relative to the second end 111 thereof. As earlier described with respect to the fastener body 40, a cavity 113 is defined therebetween the spaced tongues 105 and the circumscribing flange 112 on the first portion 101 of the fastener body 100. The cavity 113 operates in a manner similar to that which was earlier described with respect to the fastener body 40. As should be appreciated from a study of FIG. 17, and where the form of the invention as seen in FIG. 16 is shown in a fully assembled configuration. It will be appreciated that the absence of any protuberance on the exterior facing surface 104 of the second portion 102 permits the construction member 13 to rotate freely thereabout same in order to achieve several of the benefits of the present invention. As seen in FIGS. 16 and 17, a locking member 70, as earlier described, is operable to matingly cooperate with the alternative form of the fastener body 100 to thereby secure the first and second construction members 12 and 13 together and further facilitates, at least in part, the rotation of the second construction member 13 relative to the first construction member. As will be appreciated from the drawings, the second portion 102 of the fastener body 100 and which facilitates rotation of the construction element relative thereto has a substantially uniform outside diametral dimension when measured from the first end 110 of the main body 103 to the partially circumscribing flange 112 which is located at the second end 111 thereof.

Referring now to FIG. 18, yet another form of a construction system of the present invention is generally indicated by the numeral 120 therein. As seen in FIG. 18, this form of the construction system similarly uses a construction element, here indicated by the numeral 12, and which is of similar design to that earlier described with respect to the other forms of the invention. As seen, in that exploded drawing, the construction element 12 has a main body 14 defining passageways 30 therethrough having dimensions and other characteristics similar to that which was earlier described. As seen in FIG. 18, the present form 120 of a construction system includes a fastener body 121 having a main body 122 which is matingly received within the passageway 30 defined by the construction member 12. As illustrated in that exploded view, the main body 122 of the fastener body 121 has a top surface 123, and an opposite bottom surface 124 which are disposed in substantially parallel, spaced relation one relative to the other. Still further, the main body has a peripheral edge 125 and further defines a passageway 126 which extends therethrough from the top surface 123 to the bottom surface 124. As illustrated in FIG. 18, the passageway 126 is substantially coaxially aligned relative to the passageway 30 formed in the construction member 12. The peripheral edge 125 is defined by an outside diametral dimension which is less than the maximum inside diametral dimension of the passageway 30 thereby facilitating the telescoping receipt of the main body 122 in at least a portion of the passageway 30 as defined by the construction member 12. It will be seen by a study of FIG. 18 that a plurality of spaced, longitudinally extending cavities 130 are formed in and about the peripheral edge 125. The spaced, longitudinally extending cavities 130 thereby define discrete ribs 131 which have a width dimension which facilitates their individual receipt within the respective orientation grooves 34 as defined within the passageway 30 of the construction member 12. As will be appreciated, these longitudinally extending cavities 130 extend from the bottom surface 124 in the direction of the top surface 123. An engagement surface 132 is defined endwardly of the longitudinally extending cavities and is operable to engage the tops of the individual ribs 36 which extend radially inwardly relative to the passageway 30 and which form, at least in part, the orientation grooves 34 therebetween. Consequently, it will be appreciated that the main body 122 can only be inserted a predetermined distance into the passageway 30. However, the arrangement of the ribs 131 and longitudinally extending cavities 130 are such that the main body is releasably engageable with the construction element and is not rotatable relative thereto. It will be appreciated, however, and in yet another alternative form of the invention which is not illustrated herein, it is possible to fabricate a main body 122 which has a substantially smooth peripheral edge and which is operable to rest on top of the ribs 36 and thereby facilitate the rotation of the main body 122 relative to the passageway 30. Still further, the dimensions of the main body 122 and the length of the respective longitudinally extending cavities 130 are such that the main body 122 is substantially received within the passageway 30 and does not extend substantially beyond the outwardly facing surface of the construction member 12.

The construction system 120 as seen in FIG. 18 includes a locking member which is generally indicated by the numeral 140. The locking member has a main body 141 which is matingly received within the passageway 30 that is defined by the construction element 12. Still further, the main body 141 has a top surface 142, and an opposite bottom surface 143. The main body 141 is further defined by a peripheral edge 144. Additionally, a passageway 145 extends therethrough the main body 141 between the top surface 142 and the bottom surface 143. The passageway 145 extending through the main body 141 is substantially coaxially aligned relative to the passageway 126 as defined by the main body 122 of the fastener body 121. As seen in FIG. 18, it will be appreciated that a plurality of threads 146 are formed in the main body 141 and which define the outer peripheral edge of the passageway 145. As illustrated in FIG. 18, it will be appreciated that a plurality of spaced longitudinally extending cavities 150 extend from the top surface 142 in the direction of the bottom surface 143. The longitudinally extending cavities 150 define ribs 151 which are dimensioned so as to be matingly received in the various orientation grooves 34 which are defined between the respective ribs 36 which extend radially inwardly relative to the passageway 30 as defined by the construction member 12. An engagement surface 152 is defined endwardly of the longitudinally extending cavities 150. Similar to that described with respect to the fastener body 121, the individual engagement surfaces 152 allow the main body 141 to be received within the passageway 30 and thereafter rest against the ends of the respective ribs 36, and which extend radially inwardly relative to the passageway 30. As will be understood, the main body 141 is substantially received within the passageway 30 and does not extend substantially outwardly relative to the outwardly facing surface thereof. In yet another alternative form of the invention, it should be recognized that the main body 141 of the locking member 140 could be rendered in a form whereby the peripheral edge 144 would be substantially smooth and would rest on top of the plurality of ribs 36 which are positioned within the passageway 30. In this fashion, the locking member 140 could be rendered operable to rotate relative to the passageway.

Referring still to FIG. 18, the construction system 120 of the present invention includes a second construction element which is generally indicated by the numeral 160. As seen therein, the construction element may include such assemblies as a ball joint 161; a hook member 162; and a loop member 163 which may facilitate the attachment of the construction element 12 to other assemblies (not shown). These assemblies 160 are merely exemplary of a wide range of assemblies which could be fabricated, and which include, but are not limited to pulleys; rocker arms; sprockets; wheels; swivels and the like. The second construction element 160 having the several forms 161; 162; and 163 respectively, each includes a hexagonal shaped flange member 164 which may be engaged by a suitable box end of a wrench and which would could then impart rotational movement to same. Other means for imparting rotational movement to the assembly 160 could also be employed. This could include providing a screw-driver receiving head; an Allen bolt, a thumb screw and similar arrangements. Extending normally downwardly from the hexagonal flange member 164 is a threaded shaft 165 which has an outside diametral dimension which allows it to be received through the coaxially aligned passageways 126 and 145 which are formed in the fastener body 121 and the locking member 140, respectively. Still further, the threaded shaft 165 has a length dimension so as to permit the threaded shaft to be threadably received within the passageway 145 formed in the locking member 140. In an alternative form of the invention, the passageway 145 may have a smooth bore when fabricated, and the threads may be subsequently formed by the use of self tapping screws and the like. By threadably advancing the threaded shaft 165 into the passageway 145, the hexagonal flange member 164 exerts force on the main body 122 of the fastener body and further draws the main body 141 of the locking member 140 into the passageway 30 and into resting engagement thereagainst the plurality of ribs 36. In this way, the second construction element 160 is received in the coaxially aligned passageways as defined by the fastener body and locking member respectively and is thereby secured to the construction element 12 in a novel way. Therefore, the construction system 120 includes a second construction element 160 having a shaft 165 which releasably engages the main body 141 of the locking member 140 so as to releasably secure the second construction element to the first construction element 12. In the arrangement as seen in FIG. 18, the fastener body 121, and the locking member 140 cannot rotate when they are each received within the passageway 30 as defined by the first construction element 12. However, as earlier noted, in an alternative form of the invention, the fastener body and the locking member may be rendered operable to freely rotate when they are each received within the passageway 30 as defined by the first construction element. As earlier disclosed, this is achieved by providing a main body for each of the elements which has a substantially smooth peripheral edge and which has no protruding ribs extending therefrom. As described above, the second construction element 160 may be selected from the group comprising a ball joint; a hook member; and a loop member 161; 162; and 163, respectively.

OPERATION

The operation of the described embodiments of the present invention are believed to be readily apparent and are briefly summarized at this point.

As seen in FIG. 1 and following, a construction system 10 of the present invention includes a first construction element 12 which has at least one passageway 30 which extends therethrough; a fastener body 40 having a first and a second portion 41 and 42, and wherein the first portion 41 of the fastener body 40 is received in the passageway 30 defined by the first construction element 12; and a locking member 70 having first and second portions 71 and 72 which individually matingly cooperate with the respective first and second portions 41 and 42 of the fastener body 40 to secure the fastener body 40 to the first construction element.

Still another aspect of the present invention relates to a construction system 10 which includes a first and a second construction element 12 and 13. Each of the construction elements have at least one passageway 30 which extends therethrough. In the arrangement as seen in the drawings, a fastener body 40 having a support member 43 which has opposite first and second ends 44 and 45, and wherein the fastener body 40 further has a first and a second portion 41 and 42 which are disposed in predetermined, spaced relation, one relative to the other, and which extend normally outwardly relative to the opposite first and second ends 44 and 45 of the support member 43. The first and second portions 41 and 42 of the fastener body are dimensioned so as to be individually telescopingly received within the respective passageways 30 which are defined by the first and second construction elements 12 and 13.

As seen in the drawings, a locking member 70 is provided and which has a support member 73 which has opposite first and second ends 74 and 75, respectively, and an intermediate region 76 therebetween the first and second ends. The locking member 70 further has a first and a second portion 71 and 72 which are disposed in predetermined spaced relation one relative to the other, and which extend normally outwardly relative to the opposite first and second ends 74 and 75 of the support member 73. The first and second portions of the locking member 70 are dimensioned so as to be individually telescoping received within the respective passageways 30 which are defined by the first and second construction elements 12 and 13, and to further be individually telescopingly received in and otherwise releasably cooperate with the first and second portions 41 and 42 of the fastener body 40 to secure the fastener body to the first and second construction elements. In the arrangement as seen in the drawings, the support members 43 and 73 of the respective fastener body 40, and the locking member 70, in some forms of the invention, are individually, substantially planar and have a substantially similar length dimension. In other forms of the invention, the support members 43 and 73 of the fastener body, and the locking member respectfully are non planar, yet still have substantially similar length dimensions. In still another form of the invention, the support members 43 and 73 of the fastener body 40, and the locking member 70, respectfully, are substantially non planar, and have a dissimilar length dimensions.

In the arrangement as seen in the drawings, the first and second construction elements 12 and 13 may be oriented in a fixed orientation one relative to the other. This fixed orientation is effected by the presence of the tongue 56 which extends radially outwardly relative to the exterior facing surface 47 of the respective first and second portions 41 and 42 respectively. Still further, in other forms of the invention, one of the first or second construction elements 12 or 13 is moveable or otherwise partially rotatable along a path of travel one relative to the other. Still in other forms of the invention, the first and second construction elements 12 and 13 are individually moveable, or at least partially rotatable along individual paths of travel.

In the present invention, a passageway 54 is formed in each of the first and second portions 41 and 42 of the fastener body 40, and which extends therethrough, and wherein the respective first and second portions 71 and 72 of the locking member 70 are dimensioned to be telescopingly received within the respective passageways defined by the first and second portions of the fastener body. In the arrangement as seen in the drawings, the respective first and second portions 71 and 72 of locking member 70 have a first end 81, and an opposite, distal, second end 82, and an intermediate portion 86, therebetween. In the arrangement as seen in the drawings, the outside diametral dimension 92 of the distal second end 82 is greater than an outside diametral dimension 93 of the intermediate portion. Still further, the distal second end 82 of each of the first and second portions 71 and 72 of the locking member 70 are resiliently deformable so as to pass through the passageway 54 which is defined by the first and second portions 41 and 42 of the fastener body. In addition to the foregoing, the first and second portions 41 and 42 of the fastener body each have an exterior facing surface 47, and wherein a tongue 56 is made integral with at least one of the exterior surfaces of the respective first and second portions of the fastener body and which extends substantially normally, radially, outwardly relative thereto.

Figure 11:
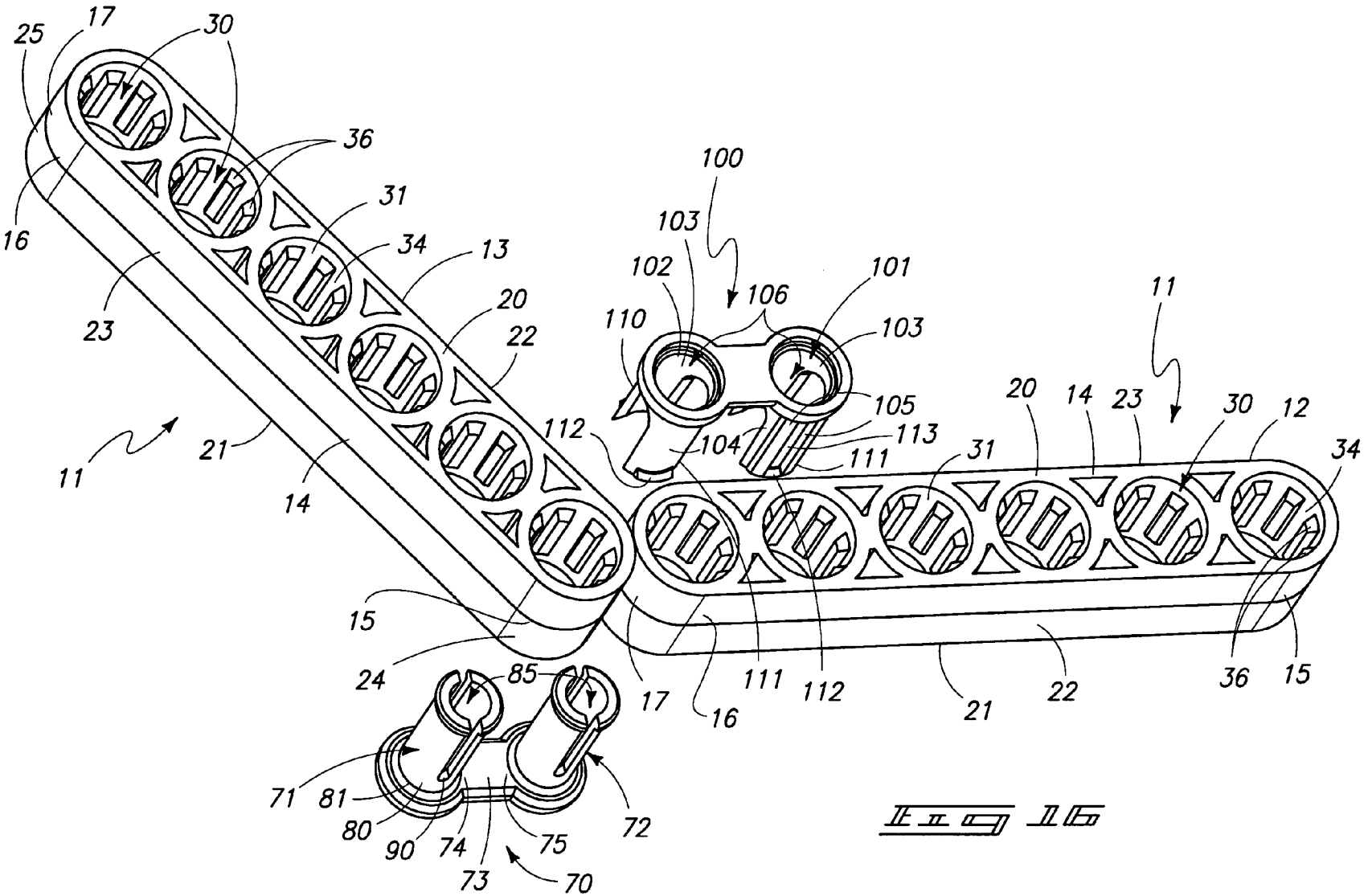
Figure 11:
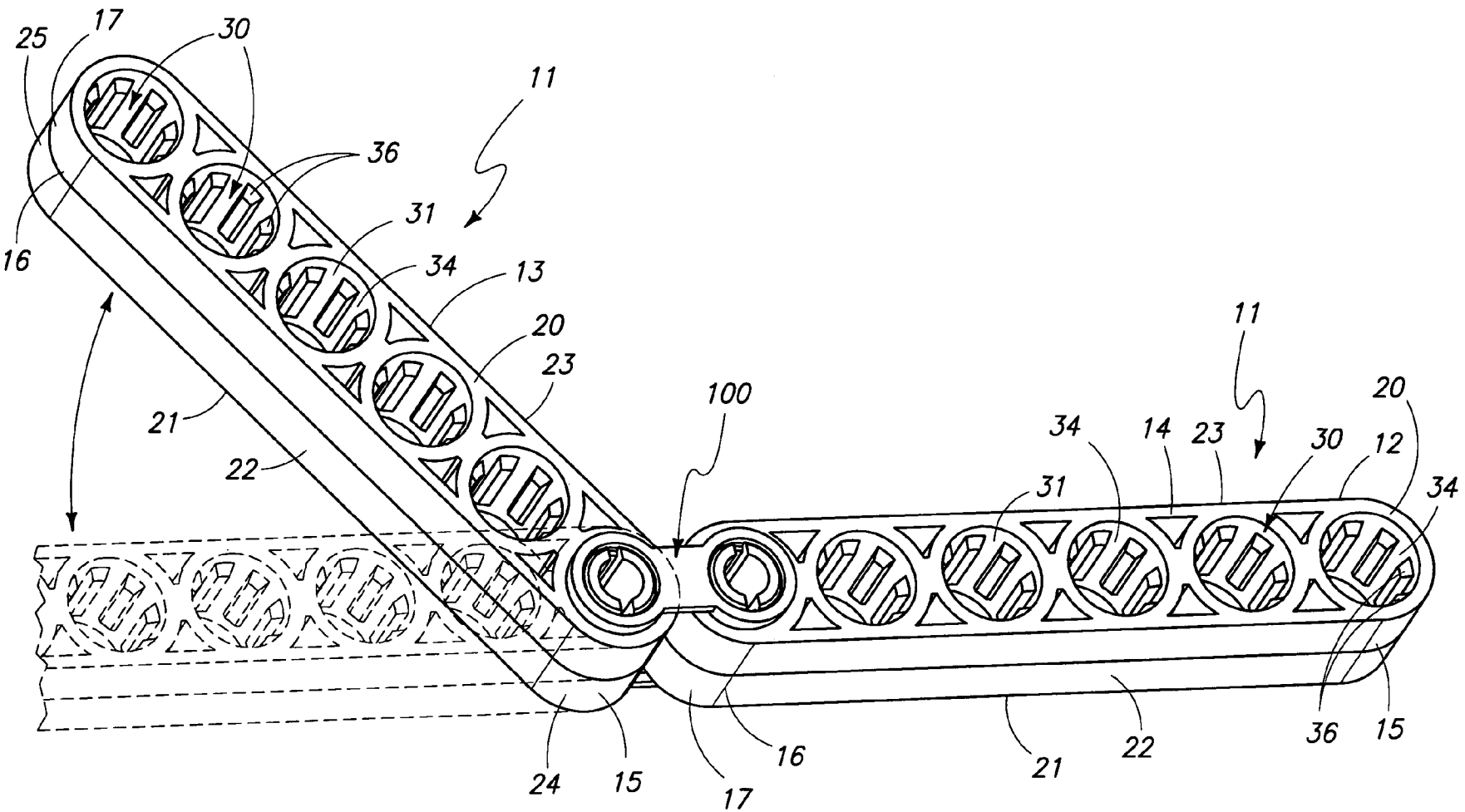

Still further, and as seen in the drawings, the respective passageways 30 as defined by the first and second construction elements 12 and 13 define an orientation groove 34 which is dimensioned to slideably and matingly receive the tongue. The tongue substantially fixedly, and angularly orients at least one of the construction elements 12 or 13 relative to the fastener body 40. As seen in the drawings, the respective passageways 30 may define a plurality of orientation grooves 34 and which facilitate the positioning of at least one of the construction elements in a plurality of angular orientations relative to the fastener body 40. In some forms of the invention as seen in the drawings, the first and second portions 41 and 42 of the respective fastener body, and locking member 71 and 72 each have a length dimension which permits at least two construction elements to be releasably mounted to at least one of the first and second portions of the respective fastener body and locking member, respectively. In other forms of the invention as earlier discussed, the first and second portions 41 and 42 of the fastener body 40, and the first and second portions 71 and 72 of locking member 70 are oriented in a predetermined substantially parallel orientation, one relative to the other. In still other forms of the invention as seen in FIG. 13, these same portions may be in a nonparallel orientation, one relative to the other. In still another form of the invention as seen in FIG. 11, the fastener body 40 may be provided and which has a third portion 42A which has dimensions similar to the first and second portions 41 and 42 and which is telescopingly and matingly received within a passageway 30 defined by yet a third construction element. Still further, the locking member 70 includes a third portion 72A which has dimensions similar to the first and second portions 71 and 72 of the locking member 70. In this arrangement, the third portion 42A of the locking member 40 matingly cooperates with the third portion 72A of the fastener body 70 to fasten the third construction element to the first, second and third construction elements.

Therefore it will be seen that the construction system 10 of the present invention is simple in operation and allows a multitude of construction elements to be releasably joined together in a fashion not possible heretofore. The present invention further avoids many of the shortcomings attendant with the prior art practices, and other assemblies which have been used for similar purposes.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A construction system, comprising:

a first and a second construction element each having a first passageway which extends therethrough, and each having a top surface and a bottom surface;

a fastener body having a support member which has opposite first and second ends, and wherein the fastener body further has a first and a second portion which are disposed in predetermined spaced relation, one relative to the other, and which extend normally outwardly relative to the opposite first and second ends of the support member, and wherein the first and second portions of the fastener body each define a longitudinally extending second passageway, and which each are dimensioned so as to be individually telescopingly received through the top surfaces of the first and second construction elements and within the respective first passageways therein, and wherein the first and second portions of the fastener body each have a first end, and an opposite second end, and a circumscribing groove is located at the first ends, and a partially circumscribing flange is located at the second ends, and wherein the circumscribing flanges matingly engage the respective first and second construction elements; and a locking member having a support member which has opposite first and second ends, and wherein the locking member further has a first and a second portion which are disposed in predetermined spaced relation one relative to the other, and which extend normally outwardly relative to the opposite first and second ends of the support member, and wherein the first and second portions of the locking member each have a first end, and an opposite second end, and a discontinuous flange is located at the second end, and wherein the first and second portions of the locking member are dimensioned to be individually telescoping received through the bottom surfaces of the first and second construction elements and within the respective second passageways defined by the first and second portions of the fastener body, and wherein the discontinuous flange of the first and second portions of the locking member respectively engage the circumscribing grooves of the first and second portions of the fastener body to secure the fastener body to the first and second construction elements.

2. A construction system as claimed in claim 1, and wherein the support member of the fastener body and locking member are substantial planar, and have a substantially similar length dimension.

3. A construction system as claimed in claim 1, and wherein the support member of the fastener body, and the locking member are non planar, and have a substantially similar length dimension.

4. A construction system as claimed in claim 1, and wherein the support member of the fastener body and the locking member are substantially non planar, and have a dissimilar length dimension.

5. A construction system as claimed in claim 1, and wherein the first and second construction elements are oriented in a fixed orientation one relative to the other.

6. A construction system as claimed in claim 1, and wherein one of the first or second construction elements is moveable along a path of travel, one relative to the other.

7. A construction system as claimed in claim 1, and wherein the first and the second construction elements are moveable along individual paths of travel, one relative to the other.

8. A construction system as claimed in claim 1, and wherein the fastener body is releasably affixed to the first and second construction elements in the manner of a snap-fit, and wherein the locking member is releasably affixed to the fastener body in the manner of a snap-fit.

9. A construction system as claimed in claim 1, and wherein each of the respective first and second portions of locking member have an intermediate portion between the first and second ends, and wherein the outside diametral dimension of the second end is greater than an outside diametral dimension of the intermediate portion, and wherein the second end of each of the first and second portions of the locking member are resiliently deformed so as to pass through the second passageway which is defined by the first and second portions of the fastener body.

10. A construction system as claimed in claim 1, and wherein the first and second portions of the fastener body each have an exterior surface, and wherein a tongue is made integral with at least one of the exterior surfaces of one of the first and second portions of the fastener body and which extends substantially normally outwardly relative thereto.

11. A construction system as claimed in claim 10, and wherein at least one of the respective passageways as defined by the first and second construction elements define an orientation groove which is dimensioned to slideably and matingly receive the tongue, and wherein the tongue substantially fixedly, and angularly orients at least one of the construction elements relative to the fastener body.

12. A construction system as claimed in claim 11, and wherein at least one of the respective passageways as defined by the first and second construction elements define a plurality of orientation grooves and which facilitates the positioning of at least one of the construction elements in a plurality of substantially fixed angular orientations relative to the fastener body.

13. A construction system, comprising:

first and second construction elements each with a top surface and a bottom surface, and each having a first passageway formed therein, and which extends therethrough, and wherein each first passageway has at least one orientation groove which communicates with, and extends along, the respective passageways;

a fastener body having a resiliently deformable first and second portion and which are individually dimensioned for telescoping, mating receipt through the top surfaces of the first and second construction elements and within the respective first passageways therein, and wherein each of the first and second portions have an exterior facing surface which defines at least one tongue which is dimensioned to matingly cooperate with the at least one orientation groove defined by each of the passageways of the respective first and second construction members, and wherein each portion of the fastener body has an interior facing surface which defines a longitudinally extending second passageway which extends therethrough, and wherein the first and second portion of the fastener body are located in predetermined spaced relation, one relative to the other, and wherein the first and second portions of the fastener body each have a first end, and an opposite second end, and a circumscribing groove is located at the first ends of the first and second portions of the fastener body, and a partially circumscribing flange is located at the second ends of the first and second portions of the fastener body, and wherein the circumscribing flange matingly engages the respective first and second construction elements;

a locking member having a resiliently deformable first and second portion and which are individually dimensioned for telescoping mating receipt through the bottom surfaces of the first and second construction elements and within the respective longitudinally extending second passageways that are defined by each of the first and second portions of the fastener body, and wherein each of the first and second portions of the locking member have an exterior facing surface which defines an outside diametral dimension, and a distal end which defines a second outside diametral dimension, and wherein the second outside diametral dimension is greater than the first outside diametral dimension, and wherein the first and second portions of the fastener body are located in predetermined, spaced relation, one relative to the other, and wherein a discontinuous flange is located at the distal end, and wherein the discontinuous flange of the first and second portions of the locking member respectively engage the circumscribing grooves of the first and second portions of the fastener body so as to releasably attach the first and second construction elements together in a fixed orientation, one relative to the other.

14. A construction system as claimed in claim 13, and wherein first and second portions of the respective fastener body, and locking member each have a length dimension which permits at least two construction elements to be releasably mounted to each of the first and second portions of the respective fastener body and locking member, respectively.

15. A construction system as claimed in claim 13, and wherein the first and second portions of the respective fastener body and locking member are oriented in a predetermined substantially parallel orientation, one relative to the other.

16. A construction system as claimed in claim 13, and wherein the first and second portions of the respective fastener body and locking member are disposed in a non parallel orientation, one relative to the other.

17. A construction system as claimed in claim 13, and further comprising:

a third construction element having a passageway formed therein and which extends therethrough, and which has dimensions similar to the passageways defined by the first and second construction elements, and wherein the fastener body has a third portion which has dimensions similar to the first and second portions thereof, and which is telescopingly matingly received within the passageway defined by the third construction element, and wherein the locking member includes a third portion which has dimensions similar to the first and second portions of the locking member, and wherein the third portion of the locking member matingly cooperates with the third portion of the fastener body to fasten the third construction element to the first and second construction elements.

18. A construction system, comprising:

a first and a second construction element each with a top surface and a bottom surface, and oriented such that the top surfaces of each construction element are substantially coplanar, and the bottom surfaces of each construction element are substantially coplanar, and wherein each construction element has a first passageway which extends therethrough, and wherein a plurality of spaced ribs extend radially inwardly relative thereto;

a fastener body having a support member which has opposite first and second ends, and wherein the fastener body further has a first and a second portion which are disposed in predetermined spaced relation, one relative to the other, and which extend normally outwardly relative to the opposite first and second ends of the support member, and wherein each of the first and second portions define a longitudinally extending second passageway, and further are dimensioned so as to be telescopingly received through the top surfaces of the first and second construction elements and within the respective first passageways therein, and wherein the first and second portions of the fastener body each have a first end, and an opposite second end, and a circumscribing groove is located at the first ends of the first and second portions of the fastener body, and a partially circumscribing flange is located at the second ends of the first and second portions of the fastener body, and wherein the circumscribing flange matingly engages at least one of the plurality of spaced ribs within the first passageway of the first and second construction elements; and a locking member having a support member which has opposite first and second ends, and wherein the locking member further has a first and a second portion which are disposed in predetermined spaced relation one relative to the other, and which extend normally outwardly relative to the opposite first and second ends of the support member, and wherein the first and second portions of the locking member each have a first end, and an opposite second end, and a discontinuous flange is located at the second end, and wherein the first and second portions of the locking member are dimensioned so as to be individually telescopingly received through the bottom surfaces of the first and second construction elements and within the respective second passageways defined by the first and second portions of the fastener body, and which further individually telescopingly and releasably cooperate with the first and second portions of the fastener body, and wherein the discontinuous flange of the first and second portions of the locking member respectively engage the circumscribing grooves of the first and second portions of the fastener body so as to secure the fastener body to the first and second construction elements.

19. A construction system as claimed in claim 18, and wherein the first construction element cannot rotate about the first portion of the fastener body.

20. A construction system as claimed in claim 18, and wherein the first and second construction elements are oriented in a fixed orientation one relative to the other.

21. A construction system as claimed in claim 18, and wherein the first construction element is releasably affixed to the second construction element without rotation of the fastener body or the locking member relative to each other or to the first or second construction elements.

22. A construction system as claimed in claim 18, and wherein the fastener body is releasably affixed to the first and second construction elements in the manner of a snap-fit.

23. A construction system as claimed in claim 21, and wherein the locking member is releasably affixed to fastener body in the manner of a snap-fit.

* * * * *